United States Patent [19]

Rozmus et al.

[11] Patent Number: 4,548,020

[45] Date of Patent: Oct. 22, 1985

[54] ASSEMBLY FOR FILLING A CONTAINER

[75] Inventors: Walter J. Rozmus, Traverse City; Peter A. Hochstein, Sterling Heights, both of Mich.

[73] Assignee: Kelsey-Hayes Company, Romulus, Mich.

[21] Appl. No.: 419,731

[22] Filed: Sep. 20, 1982

[51] Int. Cl.[4] ..... B65B 1/00

[52] U.S. Cl. ..... 53/268; 53/281; 53/310; 53/319; 53/101; 141/198

[58] Field of Search ..... 53/88, 94, 97, 101, 53/268, 281, 306, 310, 319; 141/95, 198

[56] References Cited

U.S. PATENT DOCUMENTS

| | | | |
|---|---|---|---|
| 1,893,716 | 1/1933 | Ronzone | 53/510 |
| 2,101,156 | 12/1937 | Payne | 53/281 X |
| 3,191,354 | 6/1965 | McElroy et al. | 53/510 X |
| 3,765,142 | 10/1973 | Lindquist et al. | 53/88 X |
| 3,797,535 | 3/1974 | Kaiser | 141/198 X |
| 3,799,219 | 3/1974 | Uth et al. | 141/198 X |
| 3,996,725 | 12/1976 | Walles | 53/510 X |

FOREIGN PATENT DOCUMENTS

| | | | |
|---|---|---|---|
| 610994 | 10/1960 | Italy | 141/198 |

*Primary Examiner*—John Sipos
*Assistant Examiner*—Steven P. Weihrouch
*Attorney, Agent, or Firm*—Harold W. Milton, Jr.

[57] ABSTRACT

An assembly for filling and sealing a cavity (14) in a container (10). The assembly includes a fill passage (18) in sealing engagement with the periphery of the receiving passage (12) in the container (10). A vacuum source (24) withdraws gas from the container (10) and the assembly. Powdered material under a vacuum is supplied to a vibrating platform (44) which dispenses the material while vibrating so that the material passes through a valve (48, 52), the fill passage (18) and into the container (10). A plug magazine (26, 125) stores and delivers one spherical ball (28) at a time to the fill passage (18) for being forced into the receiving passage (12) to seal the container (10). A vacuum valve (48, 52) seals the material supply from the fill passageway (18) to maintain the vacuum in the material supply when the container (10) is received. A probe (74) has a thermistor at the lower end which changes resistance in response to a change in temperature which occurs upon the material level in the container reaching the lower end of the probe (74), in response to which the vibration of the material supply platform (44) is stopped. The probe (74) is retracted and the snout (68) is moved downwardly to force a ball (28) into the receiving passage (12) to seal the container (10). The vacuum valve (52) is closed, the source of vacuum is closed and the sealed container (10) is received and replaced by another empty container.

13 Claims, 3 Drawing Figures

ASSEMBLY FOR FILLING A CONTAINER

TECHNICAL FIELD

This invention relates to the filling and sealing of a container. The invention was specifically developed for and has found utility in the filling of a cavity in a container with powdered metal in a vacuum environment. After the container is filled and sealed, it is subjected to heat and pressure for compacting and densifying the powdered metal within the container.

BACKGROUND ART

There are systems known to the prior art which function to apply a vacuum to a container before filling the container with powdered metal and which seal the container before the container is removed from the assembly to prevent the ingress of gases into the cavity filled with the powdered metal. The problem with such prior art assemblies is the arrangement of the components and their interaction for applying a vacuum to the container, sealing the container and then sealing the container while maintaining the vacuum within the system. One area of development has been concerned with the determination of when the container is actually full of material or powdered metal to the desired level. Containers have different cavities of various configurations and volumetric capacities, yet all such containers must be filled to a consistent level.

SUMMARY OF THE INVENTION AND ADVANTAGES

The subject invention relates to an assembly for filling a container through a receiving passage of a predetermined length therein with material. The assembly includes a housing having a fill passage for communicating with the receiving passage of a container. A vacuum source withdraws gas from the container and the fill passage. Material supply means supplies material to the fill passage for filling the container through the receiving passage. The assembly includes a delivery control means having an "on" condition for allowing material to flow from the material supply means to the fill passage and an "off" position for terminating such flow and sealing the material supply means from the fill passage. Also included is a plug magazine means storing a plurality of plugs for delivering one plug at a time to the fill passage so that the plug engages the receiving passage of the container and for maintaining a vacuum seal between the plug magazine means and the fill passage to maintain a vacuum therein. A snout means is included having a bore extending thereinto from a distal end thereof and which is movable from an initial position through the fill passage to a ram position to engage a plug and force the plug into the receiving passage of the container to seal the container. The invention is characterized by probe means disposed in the bore of the snout means and movable between a retracted position and a sensing position extending through the fill passage and into the receiving passage of the container for providing a full signal when the level of material in the container reaches the probe means for controlling the delivery control means.

The assembly provides a consistent level of powdered material in the container regardless of the size or volume of cavity within the container and at a very precise level while a vacuum is maintained within the system.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENTS

Figure 1:
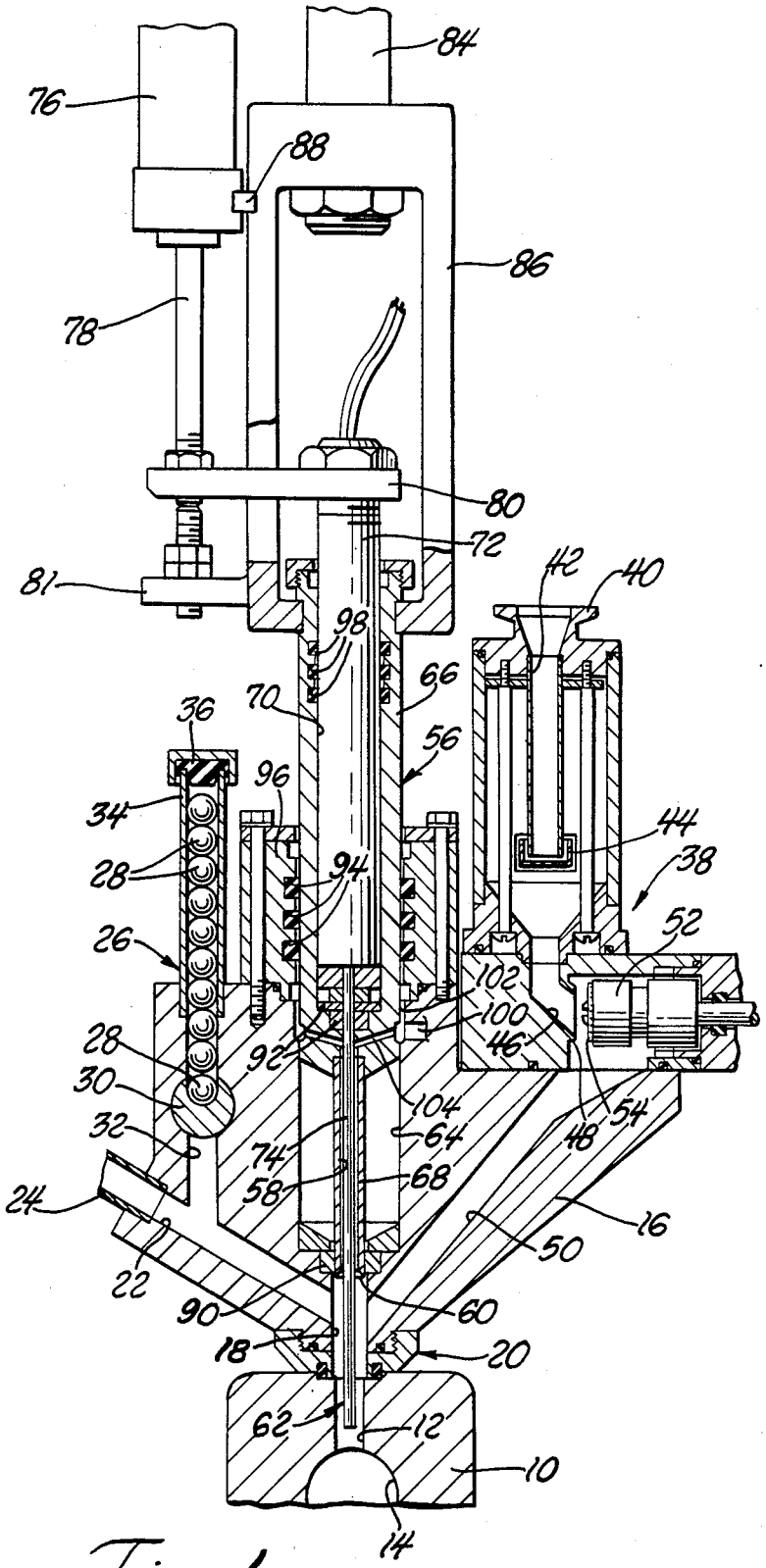
FIG. 1 is a fragmentary cross-sectional view of a first embodiment of the assembly constructed in accordance with the subject invention.

Referring first to FIG. 1, a filling assembly is shown for filling a container 10 through a receiving passage 12 of a predetermined length therein. The container 10 has a cavity 14 which may be of various different configurations and volumes and the receiving passage 12 extends from the cavity 14 to the exterior of the container 10.

The assembly includes a housing 16 having a fill passage 18 therein for communicating with the receiving passage 12 of the container 10. A seal assembly, generally indicated at 20, forms a part of the fill passage 18 and threadedly engages the lower extremity of the housing 16 and includes a snout and an elastomeric seal disposed in an annular recess surrounding the receiving passage 12 in the container 10 to effect an air or gas-type seal between the housing 16 and the container 10. One of the various different appropriate clamping apparatuses may be utilized to hold the container 10 in position tightly against the seal assembly 20.

A vacuum source, including the vacuum passageway 22 in the housing 16, is provided for withdrawing gases from the container 10 and the fill passage 18. The passage 22 is connected to a conduit 24 which is connected to a vacuum source, such as a pump, with a valve (not shown) in the line for closing off the vacuum source.

A plug magazine means, generally indicated at 26, stores a plurality of spherical plugs 28 for delivering one plug 28 at a time to the fill passage 18 so that the plug 28 engages the fill passage 12 of the container 10. The plug magazine means 26 also maintains a vacuum seal between the plug magazine means 26 and the fill passage 18 to maintain a vacuum therein. More specifically, the plug magazine means 26 includes a cylinder 30 rotatably supported in the housing 16. The cylinder 30 is in rotative sliding engagement with the housing 16 and includes a pocket for receiving one of the spherical balls 28. Upon rotation of the cylinder 30 from the position shown in FIG. 1 through 180°, the spherical plug 28 in the pocket of the cylinder will be dropped through the feed passage 32 whereupon the spherical plug 28 will move down the vacuum passage 22 and into the fill passage 18. The cylinder 30 may be rotated by a manually operated handle (not shown) disposed exteriorly of the housing 16. The spherical plugs 28 are housed within a tubular magazine 34 having a sealing cap 36 on the top thereof to maintain an air-tight seal within the tubular magazine 34. Once the sealing cap 36 is placed in position and a vacuum is applied through the tube 24, the interior of the tubular magazine 34 remains under a vacuum.

The assembly also includes a material supply means, for supplying powdered material to the fill passage 18 for filling the container 10 through the receiving passage 12 thereof.

The assembly includes a delivery control means, generally shown at 38, having an "on" condition for allowing material to flow from the material supply means to the fill passage 18 and an "off" condition for terminating such flow and sealing the material supply means from the fill passage 18. More specifically, the material supply means may include a container (not shown) attached to and in air-tight sealing engagement with the flange 40 for delivering powdered material into the inlet tube 42 of the delivery control means 38. The inlet tube 42 empties into a trough-shaped platform 44 which has sides and an open end. The platform 44 is attached to an electromagnetic vibrator which vibrates the trough-like platform 44 in an end-wise direction dumping powdered material off the open end of the platform 44 whereupon the powdered material falls into the passage 46 and through the valve seat 48 and flow passage 50 into the fill passage 18. The delivery control means 38 also includes the valve member 52 which is circular in cross section and has an end valve member 54 of elastomeric material which seats against a circular ridged or pointed valve seat 48 for maintaining an air-tight seal between the passage 50 and the passage 46. The container of material which is attached to the flange 40 for providing a supply of material to the vibrating platform 44 is under a vacuum and the vacuum in the supply container must be maintained. Accordingly, upon closure of the valve member 52 against the valve seat 48, a vacuum seal is provided to maintain a vacuum in the source of material.

The assembly includes a snout means, generally indicated at 56, having a bore 58 extending thereinto from a distal end 60. The snout means 56 is movable from an initial position illustrated in FIG. 1 through the fill passage 18 to a ram position so that the distal end 60 engages a spherical plug 28 and forces the plug 28 into the receiving passage 12 of the container 10 to seal the container 10 after it has been filled with material.

The assembly also includes a probe means, generally indicated at 62, disposed in the bore 58 of the snout means 56 and movable between a retracted position and a sensing position extending through the fill passage 18 and into the receiving passage 12 of the container 10, as illustrated in FIG. 1, for providing a full signal when the level of material in the container 10 reaches the end of the probe means for controlling the delivery control means 38 for terminating the flow of material into the container 10.

The housing 16 includes a snout cavity 64 disposed above the fill passage 18. The snout means 56 includes a piston-like upper portion 66 slidably supported within the snout cavity 64. A tubular snout member 68 extends downwardly from the bottom of the piston-like portion 56 to the distal end 60 and includes the bore 58 with the bore 58 extending upwardly through the bottom of the piston-like portion 66.

The snout means 56 includes a probe cavity 70 disposed above the bore 58. The probe means includes a cylindrical upper portion 72 slidably disposed in the probe cavity 70 and a lower extending rod-like probe 74 extending downwardly from the bottom thereof. The piston-like portion 66 of the snout means extends out of or exteriorly of the housing 16 and the cylindrical portion 72 of the probe means extends out of the piston-like portion 66 of the snout means.

The assembly includes a probe actuation means comprising the air or hydraulic-actuated cylinder 76 having a piston rod 78 extending therefrom and attached to a bracket 80 which is threadedly secured to the upper end of the cylindrical portion 72 of the probe means 62.

Figure 2:
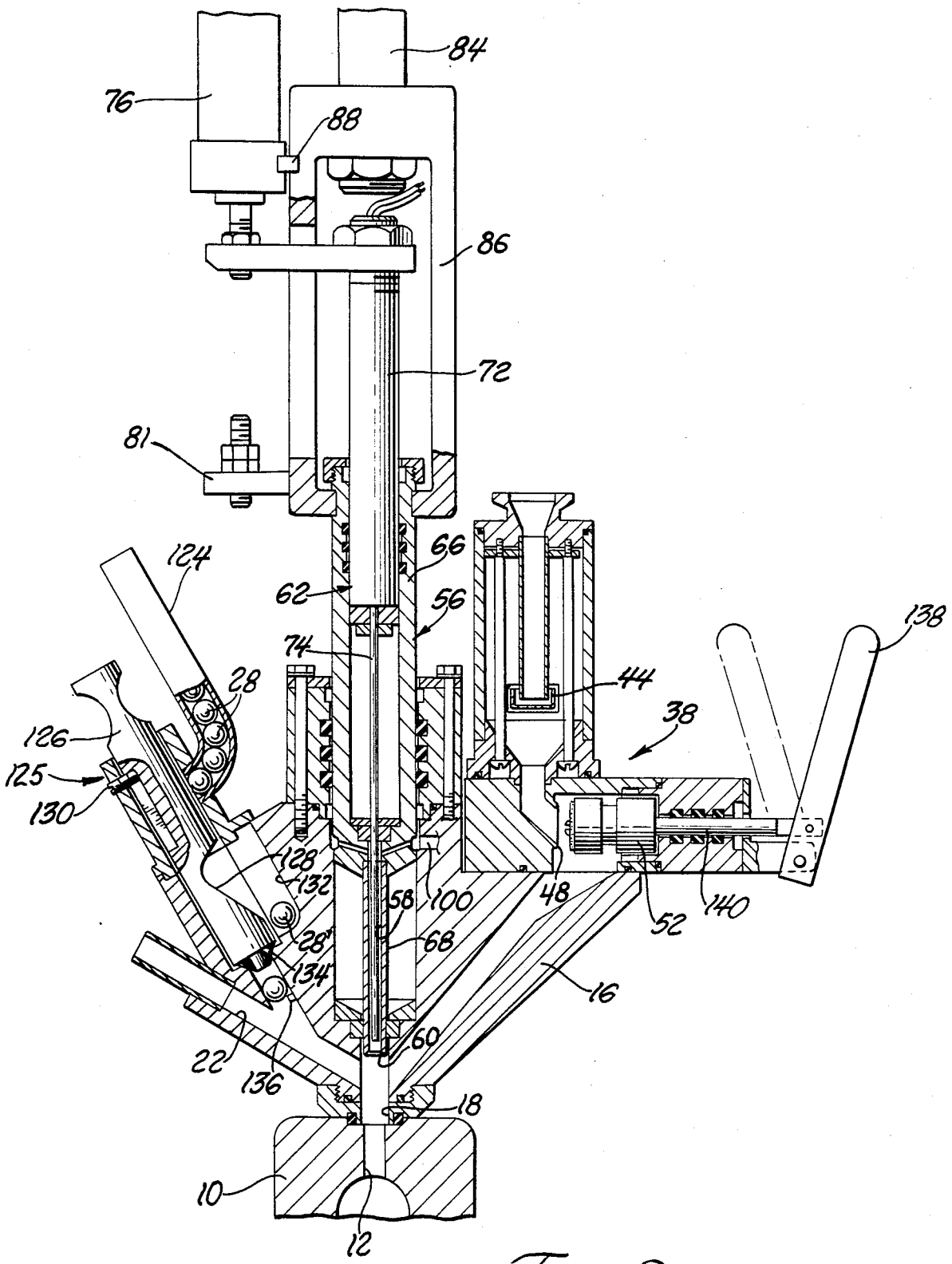
FIG. 2 is a fragmentary cross-sectional view similar to FIG. 1 showing a variation of the embodiment shown in FIG. 1.

There is also included snout actuation means including an air or hydraulic-actuated cylinder (not shown) including a rod 84 attached to a bracket 86 which is, in turn, connected to the upper extremity of the piston-like portion 66 of the snout means 56. The cylinder 76 of the probe actuation means is connected, as indicated at 88, to bracket 86 of the snout actuation means for movement therewith upon actuation of the snout actuation means to move the snout means 56 up and down and for movement relative to the snout means in moving the probe means 62 between the sensing position illustrated in FIG. 1 and a retracted position as is illustrated in FIG. 2. An adjustable stop 81 limits the downward movement of the probe means 62 to precisely position the distal end or lower end of the rod-like probe 74.

A first internal seal means 90 is disposed between the housing 16 and the tubular snout member 68 of the snout means 62 for sealing the fill passage 18 from the snout cavity 64. A second internal seal means 92 is disposed between the piston-like upper portion 66 of the snout means 56 and the rod-like probe 74 of the probe means for sealing the bore 58 from the probe cavity 70. A first external seal means 94 is disposed between the snout cavity 64 and the piston-like portion 66 of the snout means 56 for sealing the snout cavity 64 from the exterior environment. More specifically, a seal support member 96 is bolted to the housing 16 and contains circular seals for engaging the exterior of the circular surface of the piston-like portion 66 of the snout means 56. A second external seal means comprising the seal 98 is disposed between the probe cavity 70 and the cylindrical portion 72 of the probe means 62 for sealing the probe cavity 70 from the exterior environment.

There is also included an ambient air supply means for selectively supplying ambient air to the snout cavity 64 below the first external seal means 94 and for supplying air to the bore 58 below the second external seal means 98. More specifically, the ambient air supply means includes a passage 100 connected to a source of ambient air conditions through a valve and the passages 102 in the sides of the snout cavity 64 as well as the radial passages 104 in the piston-like portion 66 of the snout means 56 for supplying the ambient air into the bore 58 surrounding the tubular probe member 74.

Once the container 10 is clamped into sealing engagement with the housing 16, a vacuum is applied to the passage 22 to withdraw all gases from the system during which time the valve for supplying ambient air to the passage 100 is closed. Once the vacuum is established, the probe actuation means comprising the actuating cylinder 76 is actuated to the position illustrated in FIG. 1 against the stop 81 to move the rod-like probe 74 into the fill passageway 12 of the container 10. The delivery valve 52 is opened and the electromagnetic assembly is turned on to vibrate the platform 44 back and forth to dispense powder received from the tube 42 which, in turn, receives the powder from a container attached to the flange 40. The powder flows into the fill passage 18 and into the receiving passage 12 of the container 10 to fill the cavity 14 therein. When the powdered material reaches the lower or distal end of the rod-like probe 74, an electrical signal is provided to terminate the vibration of the platform 44 thereby terminating the flow of powdered material so that no further filling takes place. The valve 52 is then closed against the seat 48 to maintain the vacuum in the source of material. The rod-like probe 74 is retracted into the bore 58 of the tubular snout member 68 and the cylinder 30 is rotated to dispense a spherical ball 28 into position in the fill passage 18 and engaging the upper periphery of the receiving passage 12 of the container 10. The snout actuation means then moves the snout means 56 to move the tubular snout member 68 downwardly so that its lower distal end 60 engages the spherical ball to force the ball into the receiving passage 12 of the container 10 to seal the container. Thereafter, the tubular snout member 68 is retracted and the container 10 may be removed from sealing engagement with the housing 16. However, prior to removing the container 10, the ambient air valve is opened to allow ambient air or a gas, such as an inert gas, to the passage 100 and consequently into the bore 58 through the passages 104 and, in a similar fashion, the gas is allowed to flow through passages 102 about the piston-like portion 66 of the snout means 56. This prevents the vacuum therein from allowing a surge of gas pressure to flow thereinto and carry with it any dust particles which would contaminate the interior of the assembly.

The internal seals 90 and 92 prevent foreign matter, such as dust, from entering into the assembly and the interior seals 94 and 98 are vacuum-sealed to maintain the vacuum within the system. In other words, the internal seals 90 and 92 protect the vacuum seals 94 and 98 from contamination in the system. The gas supplied through the passage 100, passages 102 and 104 prevents contaminants from surging into the system and reaching the vacuum seals 94 and 98. In addition, the vacuum seals 94 and 98 are positioned a sufficient linear distance above the internal seals 90 and 92 that the parts of the components which move downwardly into the dust or contaminated areas do not retract sufficient upwardly to engage the vacuum seals 94 and 98.

Figure 3:
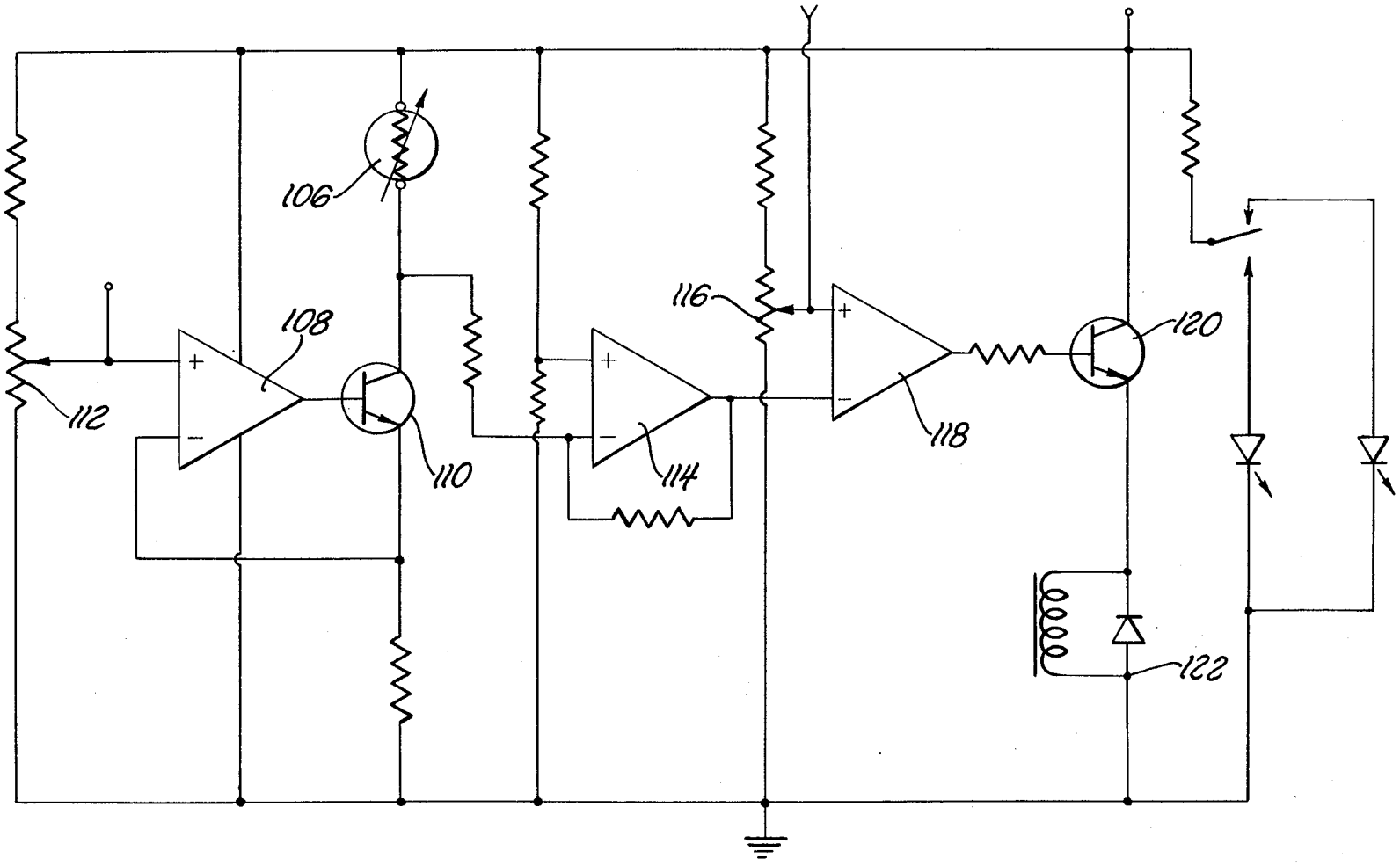
FIG. 3 is an electronic circuit suitable for use in the subject invention.

The lower or distal end of the rod-like probe 74 carries a thermistor which is shown at 106 in FIG. 3. The thermistor 106 has an electrical resistance which varies with temperature. The circuit includes an operational amplifier 108 connected to a current driver transistor 110, the two of which establish a constant current source which may be adjusted by a trimmer potentiometer 112. A differential amplifier 114 ground references the thermistor voltage. A voltage divider 116 is associated with a differential amplifier 118 utilized as a comparator which is, in turn, connected to a transistor switch 120 which powers a relay driver 122.

The thermistor 106 is provided with a constant current and, therefore, as the resistance of the thermistor 106 changes in accordance with a change in temperature, the voltage across the thermistor changes. The material level engaging the thermistor is a heat sink to lower the temperature of the thermistor thereby changing its resistance providing a signal which operates a relay which, in turn, provides a full signal to terminate the actuation of the vibration means vibrating the platform 44 to discontinue the supply of material to container 10.

The flow of incoming material past the thermistor is an insufficient heat sink to appreciably change its temperature but a constant level of material surrounding and contacting the thermistor is a sufficient heat sink. The embodiment of FIG. 2 differs from the embodiment of FIG. 1 only in the plug magazine means, generally indicated at 125. The plug magazine means 125 in FIG. 2 includes a spherical ball feed tube 124 and a shuttle member 126 having a recess 128 therein. As the shuttle member 126 is manually pulled out of the housing 16 as guided by the pin 130, the recess 128 receives one of the spherical balls 28. When the shuttle member 128 is returned to the position shown, the spherical ball or plug in the pocket 128 moves by gravity into a recess 132 in the housing 116 as illustrated by the ball 28'. In this position a seal is effected between the shuttle member 126 and the housing 16, as indicated at 134, so as to maintain the vacuum within the system. A stop member 136 holds a spherical ball in position ready to be dropped into the passage 18. The stop 136 is retracted to allow the adjacent spherical plug to drop into the passage 18 each time the shuttle member 126 is retracted. In other words, the stop 136 retracts to pass a spherical plug and immediately reestablishes itself to receive the next spherical plug 28' from the recess 132 as the shuttle member 126 is receiving the next spherical plug 28 in the recess 128 therein.

As illustrated in FIG. 2, the valve 52 is actuated between the open and closed positions by a manually actuated handle 138 attached thereto by a shaft 140 in sealing engagement with the housing disposed thereabout.

The housing 16 and the actuating cylinder for moving the actuating shaft 84 are all supported by an appropriate support structure which support structure may also support the clamping means for the container 10.

The invention has been described in an illustrative manner, and it is to be understood that the terminology which has been used is intended to be in the nature of words of description rather than limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A filling assembly for filling a container (10) through a receiving passage (12) of a predetermined length therein with material, said assembly including a housing (16) having a fill passage (18) for communicating with the receiving passage (12) of a container (10), a vacuum source (24) for withdrawing gas from the container (10) and the fill passage (12), material supply means (40) for supplying material to said fill passage (18) for filling the container (10) through the receiving passage (12), delivery control means (38) having an "on" condition for allowing material to flow from said material supply means (40) to said fill passage (18) and an "off" condition for terminating such flow and sealing said material supply means (40) from said fill passage (18), plug magazine means (26, 125) storing a plurality of plugs (28) for delivering one plug at a time to said fill passage (18) so that the plug (28) engages the receiving passage (12) of the container (10) and for maintaining a vacuum seal between said plug magazine means (26, 125) and said fill passage (18) to maintain a vacuum therein, a snout means (56) having a bore (58) extending thereinto from a distal end (60) thereof and movable from an initial position through said fill passage (18) to a ram position to engage a plug (28) and force the plug (28) into the receiving passage (12) of the container (10) to seal the container (10), and probe means (62) disposed in said bore (58) of said snout means (56) and movable between a retracted position and a sensing position extending through said fill passage (18) and into the receiving passage (12) of the container (10) for providing a full signal when the level of material in the container (10) reaches said probe means (62) for controlling said delivery control means (38), probe actuation means (76, 78, 80) for moving said probe means (62) between said retracted position and said sensing position, snout actuation means (84, 86) for moving said snout means (56) between said initial position and said ram position, said probe actuation means (76) being supported (88) by said snout actuation means (86) for movement therewith upon actuation of said snout actuation means and for movement relative to said snout means in moving said probe means between said retracted and sensing positions.

2. An assembly as set forth in claim 1 further characterized by said probe means (62) comprising a thermistor (106) having a resistance which varies with temperature, a constant current source (108, 110, 112) to said thermistor (106) for heating said thermistor (106), and detection means (114, 116, 118, 120, 122) for detecting a change in resistance of said thermistor (106) in response to a change in temperature of said thermistor (106) by contact with a level of material in the container (10) to provide the full signal to place said delivery control means (38) in said "off" condition.

3. An assembly as set forth in any one of claim 1 further characterized by said delivery control means (38) including a platform (44) for receiving material from said material supply means (40) and vibration means for vibrating said platform (44) in said "on" condition to dispense material from said platform (44) as said platform is vibrated by said vibration means.

4. An assembly as set forth in claim 3 further characterized by said delivery control means (38) including a delivery valve means (48, 52) disposed between said platform (44) and said fill passage (18) and movable between an open position allowing material flow therethrough and a closed position to provide a vacuum seal between said material supply means (40) and said fill passage (18).

5. An assembly as set forth in claim 4 further characterized by said vibration means being in said "off" condition in response to said full signal.

6. An assembly as set forth in claim 1 further characterized by said housing (16) including a snout cavity (64) disposed above said fill passage (18), said snout means (56) being slidably supported in said snout cavity (64), first internal seal means (90) disposed between said housing (16) and said snout means (56) for sealing said fill passage (18) from said snout cavity (64).

7. An assembly as set forth in claim 6 further characterized by said snout means (56) including a probe cavity (70) disposed above said bore (58) in said snout means (56), said probe means (62) being slidably supported in said probe cavity (70), second internal seal means (92) disposed between said snout means (56) and said probe means (62) for sealing said bore (58) from said probe cavity (70).

8. An assembly as set forth in claim 7 further characterized by including first external seal means (94) disposed between said snout cavity (64) and said snout means (56) for sealing said snout cavity (64) from the exterior environment.

9. An assembly as set forth in claim 8 further characterized by including second external seal means (98) disposed between said probe cavity (70) and said probe means (62) for sealing said probe cavity (70) from the exterior environment.

10. An assembly as set forth in claim 9 further characterized by including gas supply means (100, 104) for selectively supplying gas to said bore (58) of said snout means (56) below said second internal seal means (92) for relieving the vacuum in said bore (58) and said fill passage (18) prior to removing the container (10) from sealing engagement with said fill passage (18).

11. An assembly as set forth in claim 9 further characterized by including gas supply means (100, 102, 104) for selectively supplying gas to said snout cavity (64) below said first external seal means (94) and to said bore (58) of said snout means (56) below said second external seal means (98).

12. An assembly as set forth in claim 11 further characterized by said snout means (56) including a piston-like portion (66) in sliding engagement with said snout cavity (64) and extending out of said housing (16), and a tubular snout member (68) having said bore (58) therein and of smaller outer diameter than said piston-like portion (66), said tubular snout member (68) extending downwardly from said piston-like portion (66) through said first internal seal means (90) and into said fill passage (18).

13. An assembly as set forth in claim 12 further characterized by said probe means (62) including a cylindrical portion (72) in sliding engagement with said probe cavity (70) and extending out of said piston-like portion (66) of said snout means (56), and a rod-like probe (74) extending downwardly from said cylindrical portion (72) and through said second internal seal means (92) and into said bore (58) of said tubular snout member (68).

* * * * *